US006715153B2

(12) United States Patent
Mitsuhashi

(10) Patent No.: US 6,715,153 B2
(45) Date of Patent: Apr. 6, 2004

(54) HAT

(76) Inventor: Toshihisa Mitsuhashi, 6-50-8 Higashi Mukoujima, sumida-Ku, Tokyo (JP)

( * ) Notice: Subject to any disclaimer, the term of this patent is extended or adjusted under 35 U.S.C. 154(b) by 0 days.

(21) Appl. No.: 10/217,067

(22) Filed: Aug. 12, 2002

(65) Prior Publication Data

US 2003/0028951 A1 Feb. 13, 2003

(30) Foreign Application Priority Data

Aug. 13, 2001 (JP) ..... 2001-005356
Dec. 12, 2001 (JP) ..... 2001-377955

(51) Int. Cl.[7] ..... A42B 1/00
(52) U.S. Cl. ..... 2/181; 2/181.6
(58) Field of Search ..... 2/171, 171.02, 2/455, 425, 181, 181.6, 181.8

(56) References Cited

U.S. PATENT DOCUMENTS 4,468,023 A * 8/1984 Solloway ..... 482/10
6,345,395 B1 * 2/2002 Chilton ..... 2/183
6,363,539 B2 * 4/2002 Tachi et al. ..... 2/412
6,389,607 B1 * 5/2002 Wood ..... 2/425

* cited by examiner

*Primary Examiner*—Katherine Moran
(74) *Attorney, Agent, or Firm*—Polster, Lieder, Woodruff & Lucchesi

(57) ABSTRACT

A hat which is manufactured of material such as synthetic resin and the like and formed into a box-shaped, generally square pyramidal main body as a whole comprises integrally-provided foldable chocking pieces formed by cutting a plurality of evenly spaced slits on a rim around a locking hole disposed in a center of a base.

11 Claims, 17 Drawing Sheets

HAT

CROSS-REFERENCE TO RELATED APPLICATIONS

This application claims priority to Japanese Application Numbers JP 2001-005356 filed Aug. 13, 2001 and JP 2001-377955 filed Dec. 12, 2001.

STATEMENT REGARDING FEDERALLY SPONSORED RESEARCH OR DEVELOPMENT

Not Applicable.

BACKGROUND OF THE INVENTION

The present invention relates to a hat capable of exerting pyramid power for facilitating the blood circulation of brains by being worn on a head.

Conventionally, the pyramid power is famous as one of unknown energy. The fact that carcasses of small animals had mostly remained without going rotten in a stone chamber located at one third the height above the ground in the pyramid provided a Frenchman with a clue to discover the pyramid power in about 1930. Thereafter, the pyramid power has been drawing attention and a Czechoslovakian electrical engineer, Carrel found that the pyramid power improved sharpness of a worn-out razor's edge in 1954.

In Japan, experiments for determining the degree of decomposition on oranges placed in and out of a pyramid were conducted by Professor Akio Sato of Konan University. As a result of the experiments, it was figured out that the orange placed out of the pyramid went rotten soon while the other orange placed in the pyramid was dried and mummified maintaining a shine for a year long.

As to the above-mentioned pyramid power, the existence is recognized and taken by Kilrian photograph and a theory that the pyramid power is caused by energy of space microwave generating resonance action in a spatial structure of the pyramid has been proposed.

However, the substance has not been worked out yet.

On the other hand, forgetfulness, degradation in remembrance and in concentration of a human being mostly results from poor circulation of blood in the head. However, currently, hats for wearing on the head is provided with less contrivance to improve the circulation of the blood.

BRIEF SUMMARY OF THE INVENTION

It is therefore an object of the present invention to provide a hat taking the form of a pyramid for providing a wearer with psychological effects for facilitating the blood circulation in brains and for preventing forgetfulness, degradation in remembrance and in concentration, thereby enhancing the concentration by utilizing the above-mentioned pyramid power.

To solve the above-mentioned problems, a hat of the present invention is formed in a generally square pyramid as a whole and has a fitting portion at a base of a pyramidal main body. The hat can be formed in a solid, generally square pyramid and manufactured of materials such as polyurethane foam, expandable polystyrene or rubber. In this instance, the hat fitting portion is integral with the main body and is composed of a semi-spherical concave portion disposed in a generally central portion of the base in a direction of a top portion.

Therefore, a pyramid-shaped hat which is easy to be worn because of the fitting portion formed at the bottom and safe to be worn because of being manufactured of soft material can be provided. Further, with the hat, the pyramid power is effectively exerted in order to provide psychological effects for facilitating the blood circulation in brains.

In another embodiment, the hat's pyramidal main body is hollow and shaped in a generally square pyramid manufactured of synthetic resin, rubber, paper or cloth.

Therefore, a light, easily manufactured, and pyramid-shaped hat can be provided.

The hollow hat can include wide bending groove provided along the periphery of the base of the above-mentioned pyramidal main body. Therefore, a hat shaped in a regular pyramid can be formed preventing ridge portions of the generally square pyramid from bulging.

The hollow hat can also include a generally circular locking hole formed at a generally central portion of the base of the above-mentioned pyramidal main body. Foldable chocking pieces can be provided by cutting a plurality of evenly spaced slits on the rim of the above-mentioned locking hole of the above-mentioned pyramidal main body. The chocking portions can alternatively be formed of a plurality of slits in the form of a vortex extending in an outward direction from the central portion to the periphery of the base and can be curved upward by spreading each of the slits. The wholly-opened hollow hat can alternatively be provided with locking pieces manufactured of elastic bodies that are attached to the opened portion of the hat. The locking pieces can be formed from cylindrical bodies which are provided at a generally central portion inside of the pyramidal main body.

Therefore, each of the chocking pieces, chocking portion, locking pieces and the like in the locking hole fits to the head, which enables the wearer to wear the hat at an accurate angle at all times without a slip, thereby providing the psychological effects that the pyramid power is highly exerted.

In another embodiment, the hat can comprise a skeleton framework formed in generally square pyramid as a whole, in which supporting pipes protrude upward from each of corner portions where locking pipes are coupled to each other forming a generally square shape.

Therefore, a custom-made pyramidal hat adjustable to sizes of heads of wearers by cutting the locking pipes can be manufactured. And the psychological effects that the pyramid power is highly exerted by wearing the hat in desired positions and angles.

Additionally, any of the hats of the above noted embodiments can be provided with strings at generally central portions on both opposing sides of the base.

Therefore, the hat can be worn in a desired position and angle regardless of the size of the head, thereby providing the psychological effects that the pyramid power can be exerted surely.

BRIEF DESCRIPTION OF THE SEVERAL VIEWS OF THE DRAWINGS

The above and other objects of the invention will be seen by reference to the description taken in connection with the accompanying drawings, in which.

Corresponding reference numerals will be used throughout the several figures of the drawings.

DETAILED DESCRIPTION OF THE INVENTION

Figure 1:
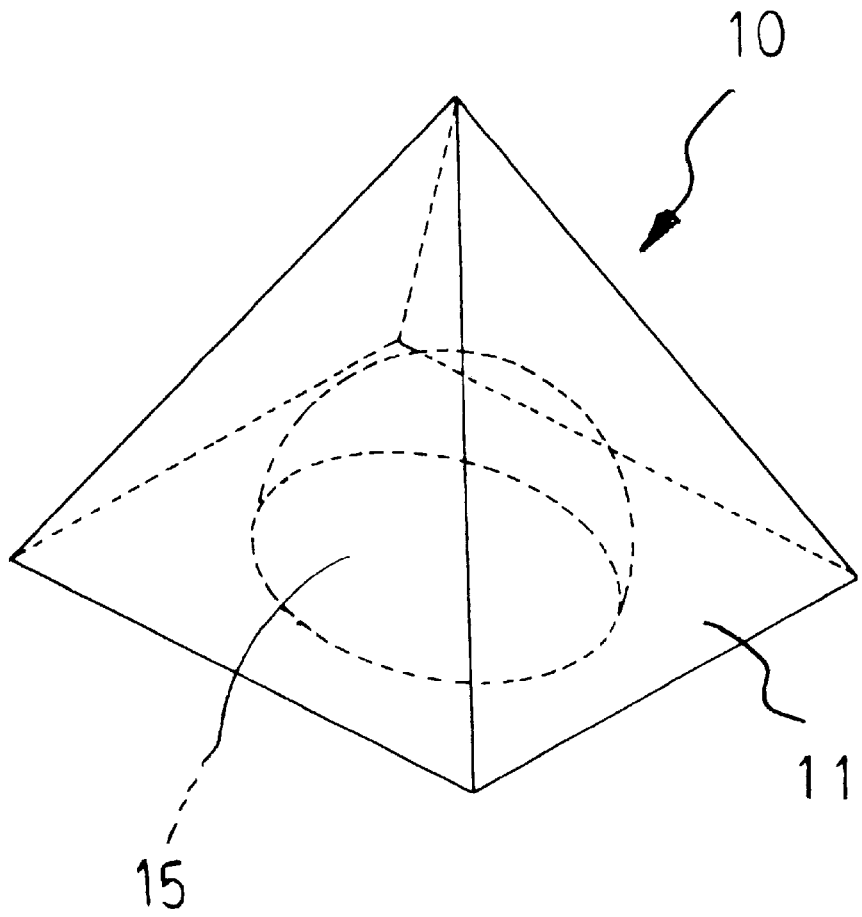
FIG. 1 is a perspective view of a first hat showing a first preferred embodiment of the present invention.
Figure 2:
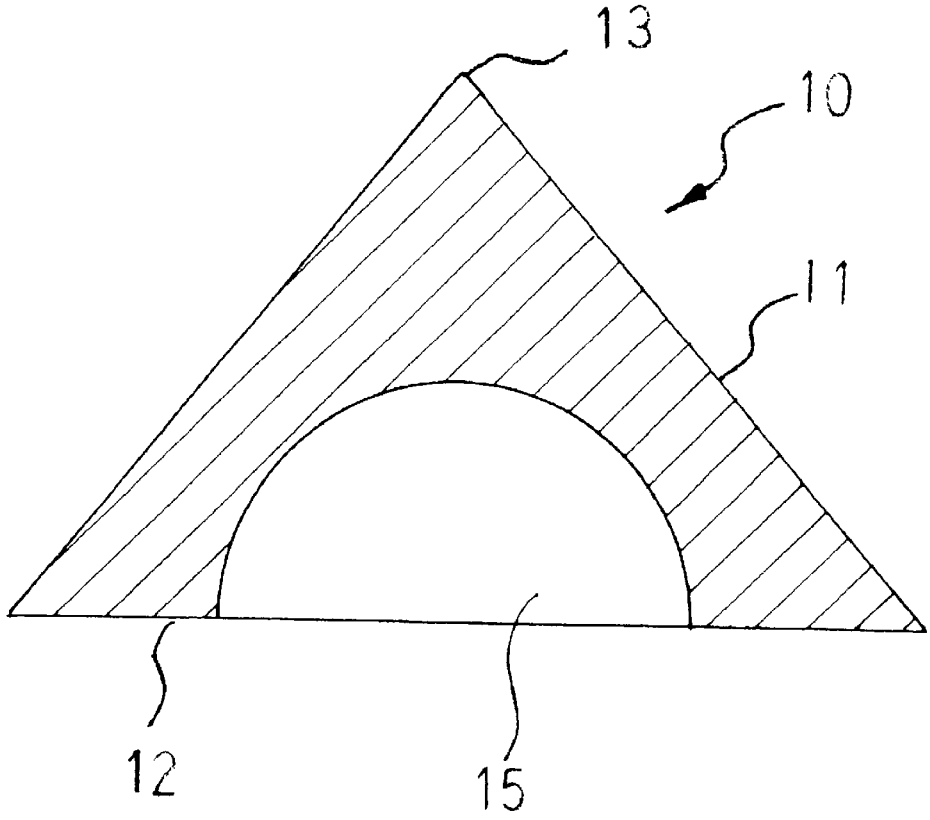
FIG. 2 is a vertical longitudinal sectional view of a midsection of FIG. 1.
Figure 3:
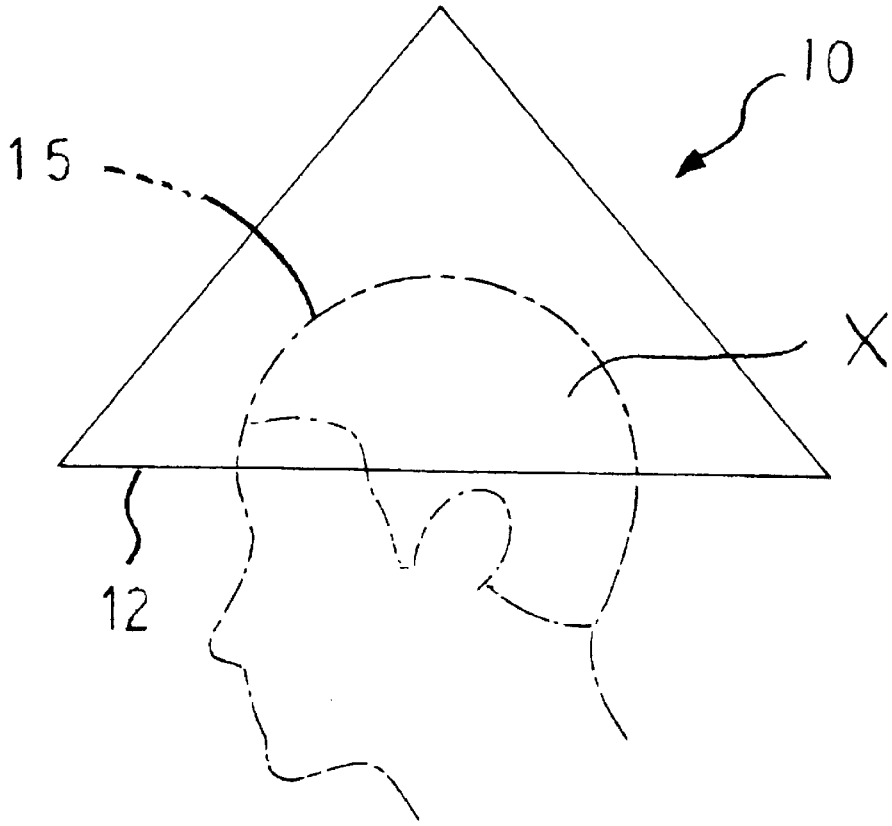
FIG. 3 is a side view showing a usage condition of a head wearing the first hat.

Referring now to the drawings, preferred embodiments of the present invention are described as below. FIG. 1 is a perspective view of a first hat showing a first preferred embodiment relating to the present invention; FIG. 2 is a vertical longitudinal sectional view of a midsection of the above-mentioned hat; and FIG. 3 is a side view for showing a usage condition of wearing the above-mentioned hat.

The first hat 10 is composed of a pyramidal main body 11 which is formed in a solid, generally square pyramid as a whole and manufactured of soft material such as rubber or light material such as polyurethane foam, expandable polystyrene and the like, in which a fitting portion 15 composed of a semi-spherical concave portion curved upwardly towards the top of the pyramid is provided in a generally central portion of a base 12 of the above-mentioned pyramidal main body 11. For example, the above-mentioned pyramidal main body 11 can be molded into a generally square pyramid as a whole in the event of manufacturing in high volume, or shaped by cutting (manually) a block of material in the event of manufacturing in low volume.

Further, a depth from the base 12 to a center of the above-mentioned fitting portion 15 preferably measures at least one third of the length from the base 12 to the top 13 of the pyramidal main body 11 in order that a crown of the head X reaches thereto when wearing the hat.

That is, a point where the energy is generated in the pyramidal main body 11 is usually assumed to be located at around one third of the height from the base to the top and the crown of the head X is placed thereat. Accordingly, the psychological effects for extending the energy into just about every sphere of the head X with the highest efficiency and facilitating the blood circulation of the brain can be exerted.

Figure 4:
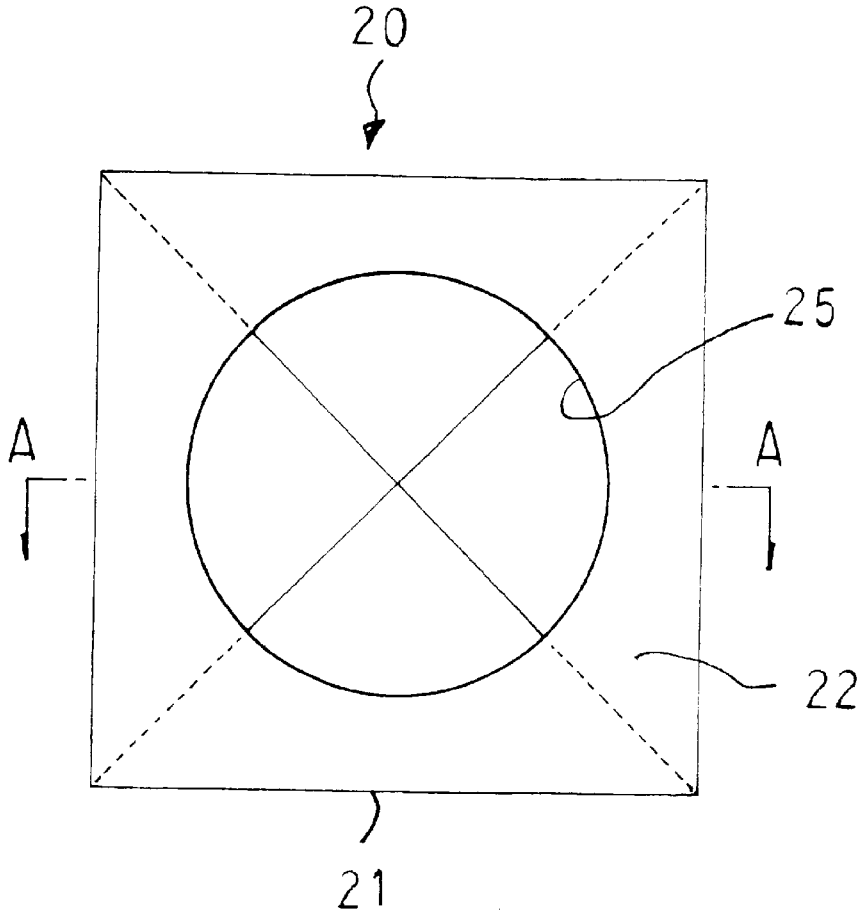
FIG. 4 is a bottom view of a second hat showing a second preferred embodiment of the present invention.
Figure 5:
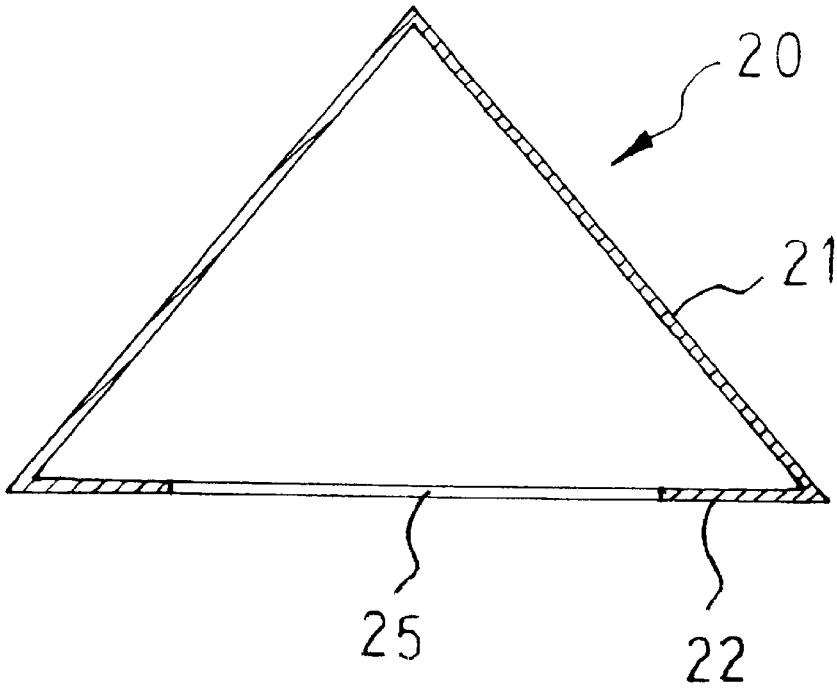
FIG. 5 is a sectional view taken on line A—A of FIG. 4.
Figure 6:
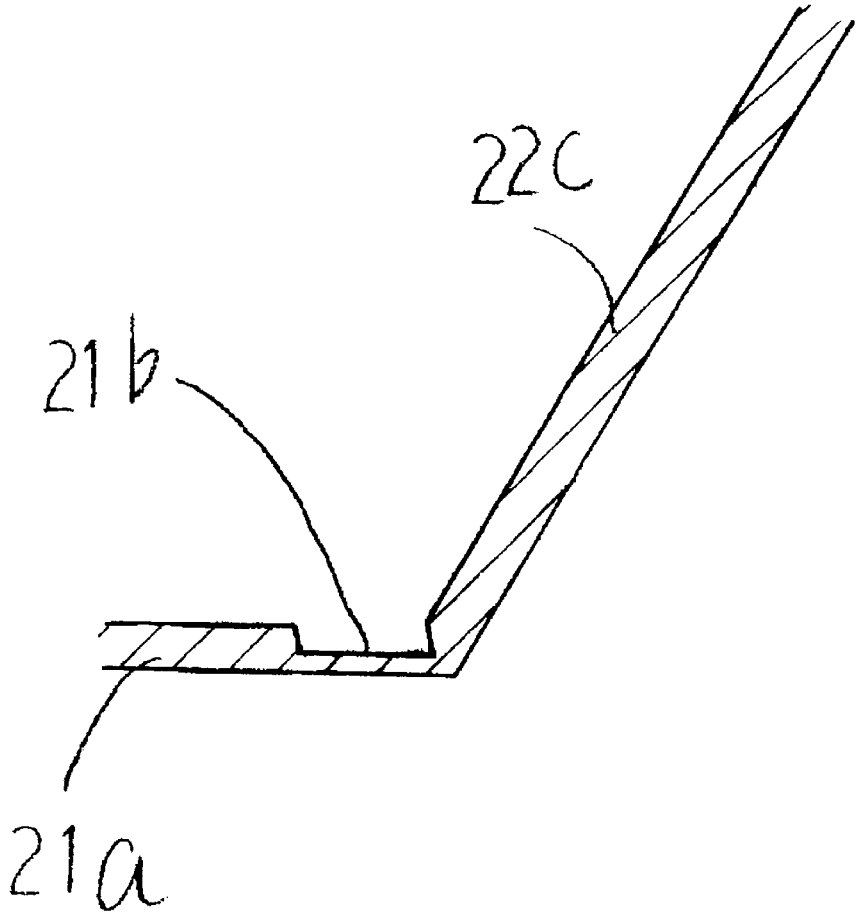
FIG. 6 is a sectional view showing a bottom portion of the second hat in a state before being folded.
Figure 7:
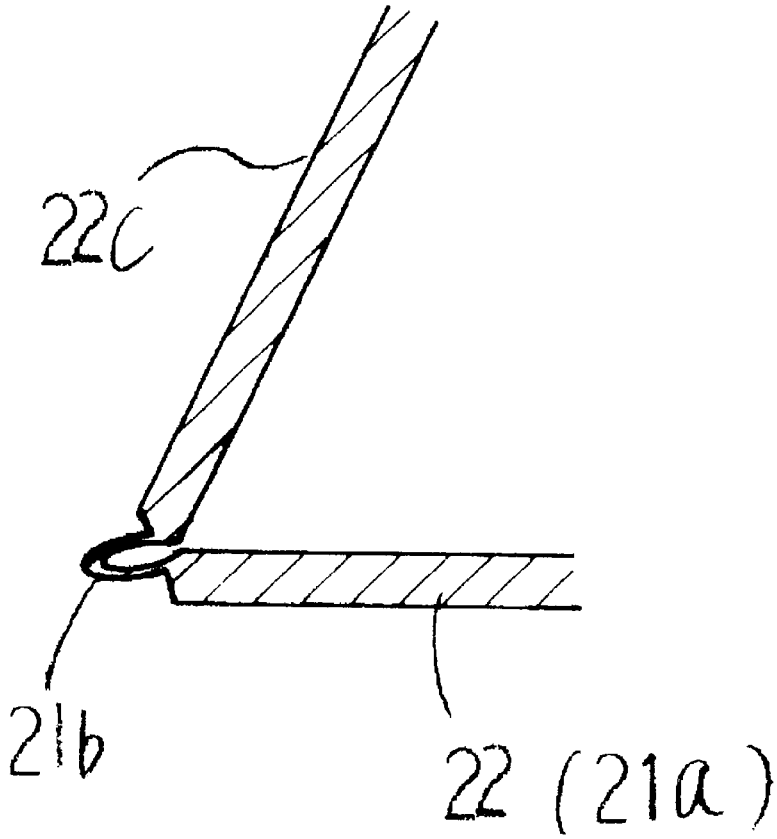
FIG. 7 is a sectional view showing the bottom portion of the second hat in a state after being folded.

FIGS. 4 and 5 are diagrams of a second hat 20 showing a second preferred embodiment of the present invention. FIG. 4 is a bottom view of the second hat 20; FIG. 5 is a sectional view taken on line A—A of FIG. 4, FIG. 6 is a sectional view for showing a bottom portion of the second hat in a state before being folded, and FIG. 7 is a sectional view for showing the bottom portion of the second hat in a state after being folded.

The second hat 20 is composed of a pyramidal main body 21 which is formed in a hollow, generally square pyramid as a whole and manufactured of materials such as synthetic resin, rubber, paper, cloth and the like, in which a locking hole 25 formed into a generally circular shape is provided in a generally central portion of a base 22 of the above-mentioned pyramidal main body 21. The above-mentioned pyramidal main body 21, for example, can be heat-molded or beaded into a generally square pyramid as a whole in the event of manufacturing in high volume, or shaped by processes of cutting, bonding and assembling of material in the event of manufacturing in low volume.

The second hat 20 can be worn simply by putting the locking hole 25 of the base 22 over the head and used easily. Further, the pyramidal main body 21 is hollowed in order to achieve lightening and portability by folding, thereby providing advantages of simplified manufacture at low costs.

Further, a wide groove 21*b* foldable along the periphery of the base 21*a* is formed in the pyramidal main body 21. In the event of forming a generally square pyramid as a whole, a portion to be the base 21*a* is necessarily folded inside at an angle larger than 90-degrees. However, being different from the event of using papers, in the event of using the above-mentioned synthetic resin as material of the pyramidal main body 21, an acute pyramidal shape can hardly be embodied because of a ridge portion 22*c* bulged by repulsive stress against the folding force. Therefore, a folding groove 21*b* is formed along the periphery of the base 21*a* in order to reduce the repulsive stress against the folding force and form the hollow, generally square pyramid comprising the base 21*a* with an acute angle. For example, in the event that the ridge portion and the base of the hat have a thickness of about 3 millimeters, an extremely acute, generally square pyramid can be achieved by reducing the thickness of the folding groove down to about 0.3 millimeters in order to prevent the ridge portion from bulging.

Figure 8:
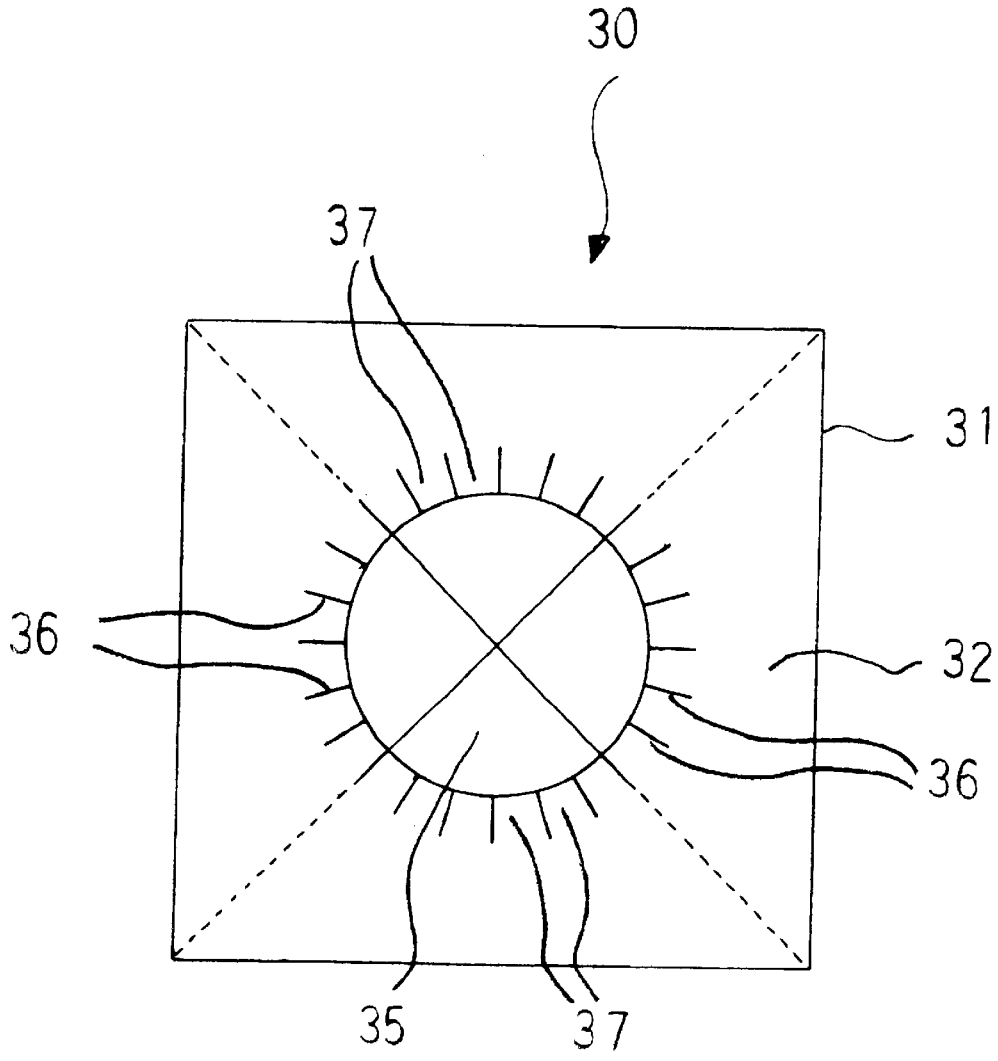
FIG. 8 is a bottom view of a third hat showing a third preferred embodiment of the present invention.
Figure 9:
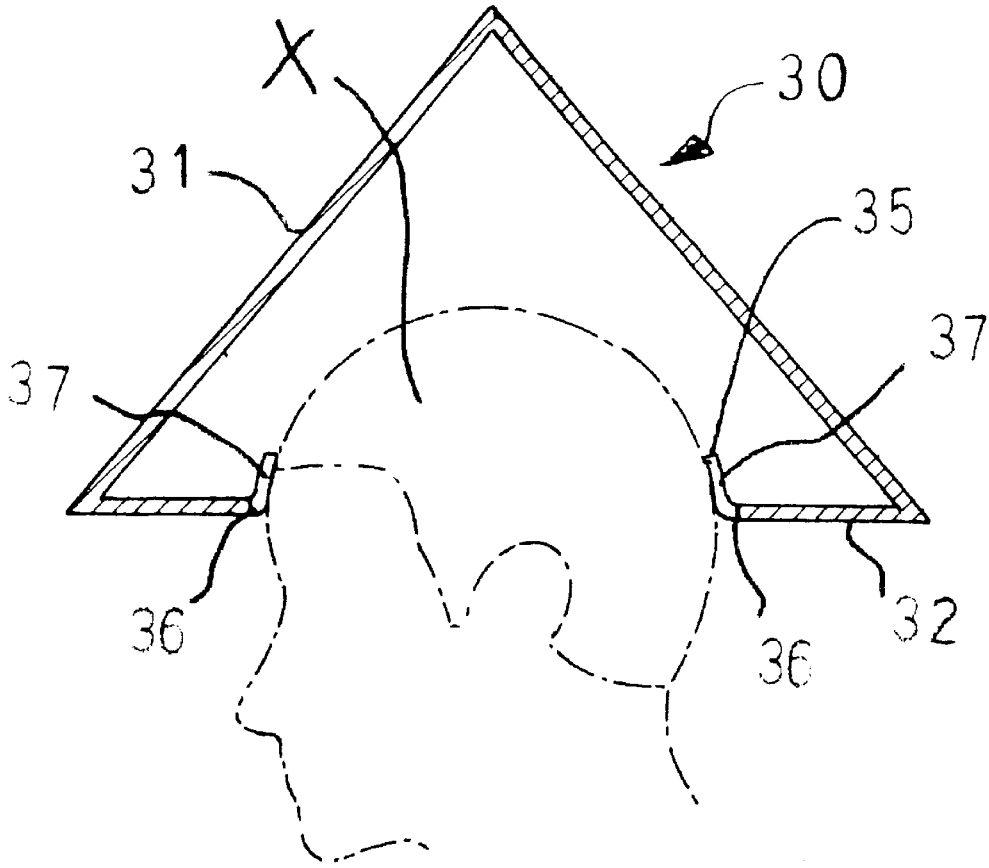
FIG. 9 is a sectional view showing a usage condition of the head wearing the third hat.

FIGS. 8 and 9 are diagrams of a third hat 30 showing a third preferred embodiment relating to the present invention. FIG. 8 is a bottom view of the third hat and FIG. 9 is a sectional view showing a usage condition of the head wearing the third hat.

The third hat 30 is composed of a hollow, generally square pyramidal main body 31 manufactured of similar material in a similar method to the second hat 20. A generally circular locking hole 35 is disposed in a generally central portion of the base 32 in the above-mentioned pyramidal main body 31. Further, the above-mentioned locking hole 35 provides a plurality of foldable chocking pieces 37 formed by cutting evenly spaced slits 36 disposed radially all around the rim of the locking hole 35.

As shown in FIG. 9, in the event of wearing the third hat 30, the locking hole 35 provided at the base 32 covers the head X, the chocking pieces 37 separated from each other by the slits 36 are pressed by the head X and folded upward, and the chocking pieces 37 fits to the circumference of the head X with elasticity, thereby providing a stable wearing condition preventing the pyramidal main body 31 from moving or slipping off the head X. Therefore, the third hat 30, can be worn properly by adjusting the position and the angle so that the crown of the head reaches to one third the height above the base and fits to the position where the strongest energy is exerted, thereby providing the psychological effects that the blood circulation of the brains can be facilitated.

Figure 10:
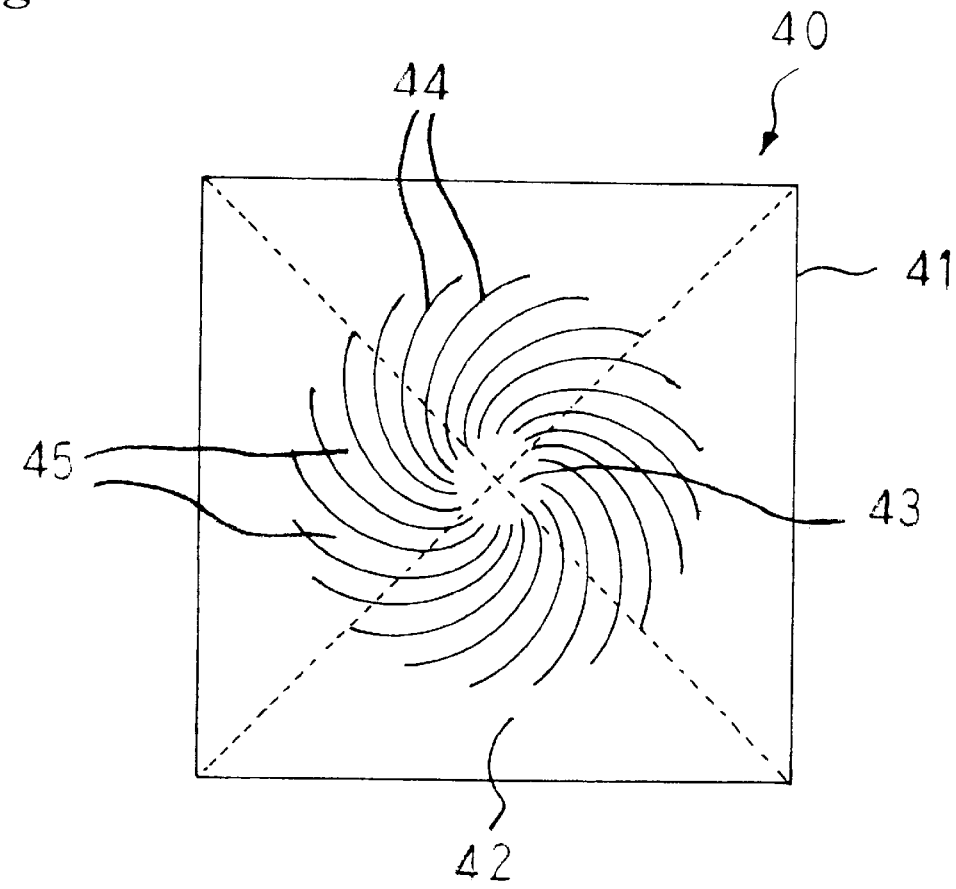
FIG. 10 is a bottom view of a fourth hat showing a fourth preferred embodiment of the present invention.

FIG. 10 is a bottom view of a fourth hat 40 showing a fourth preferred embodiment relating to the present invention.

The fourth hat 40 is composed of a hollow, generally square pyramidal main body 41 manufactured of similar material in a similar method to the second hat 20. Chocking pieces 45 are formed in a shape of a strap by cutting a plurality of slits 44 extending in the form of a vortex in directions from a generally central portion 43 to the circumference of the base 42 in the above-mentioned pyramidal main body 41.

In the event of wearing the fourth hat 40, the central portion 43 having the slits 44 is pushed upward by the crown of the head X, and the chocking pieces 45 shaped like straps are separately folded upward and fit all over the head X.

As the chocking pieces 45 shaped like straps surround and fit all over the head and produce frictional resistance over the connecting surface, the fourth hat can be worn stably without moving or slipping off the head X.

The depth and angle taken for wearing the fourth hat 40 are adjustable in a similar manner to the third hat 30. Therefore, the fourth hat 40 can be worn by adjusting the position and the angle at which the energy is exerted most strongly in order to provide the psychological effects that the blood circulation of the brains can be facilitated.

Figure 11:
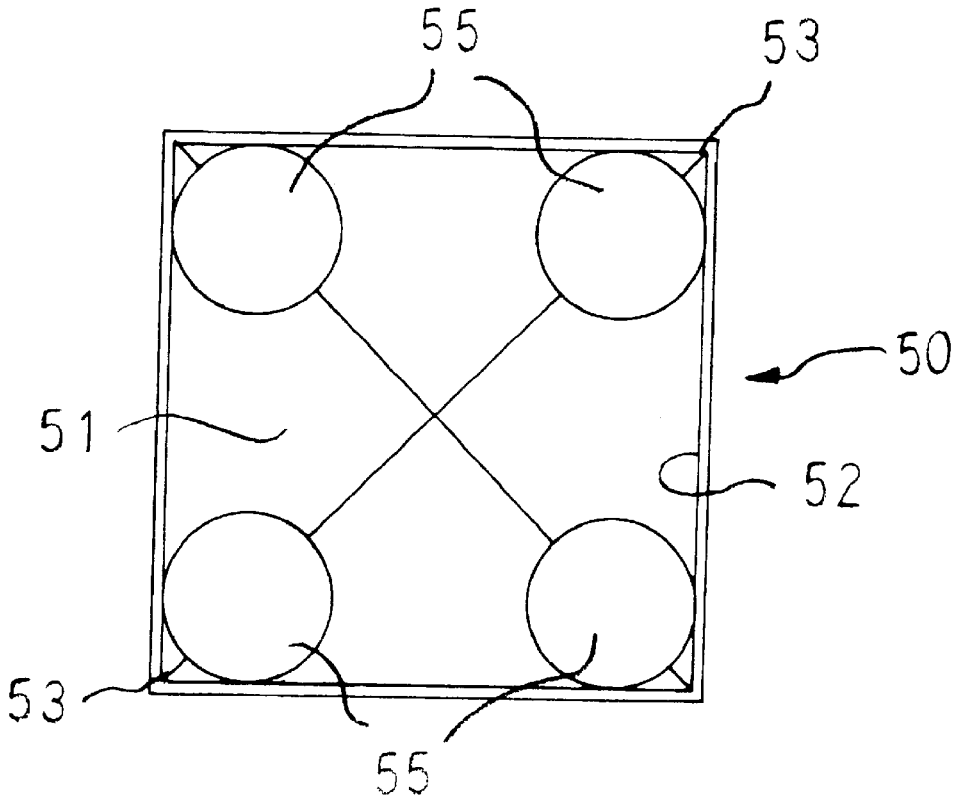
FIG. 11 is a bottom view of a fifth hat showing a fifth preferred embodiment of the present invention.
Figure 12:
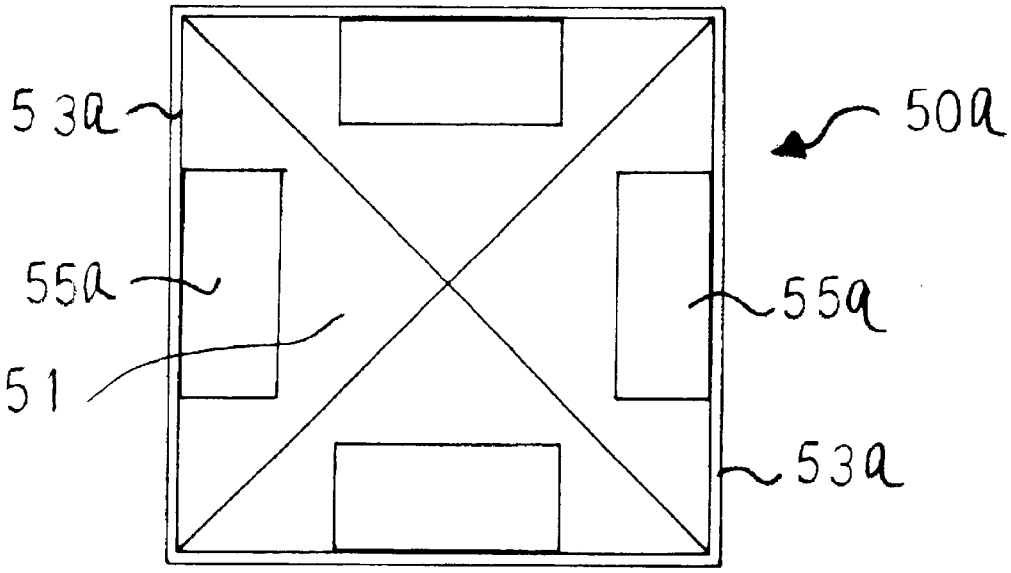
FIG. 12 is a bottom view showing another preferred embodiment of the fifth hat.
Figure 13:
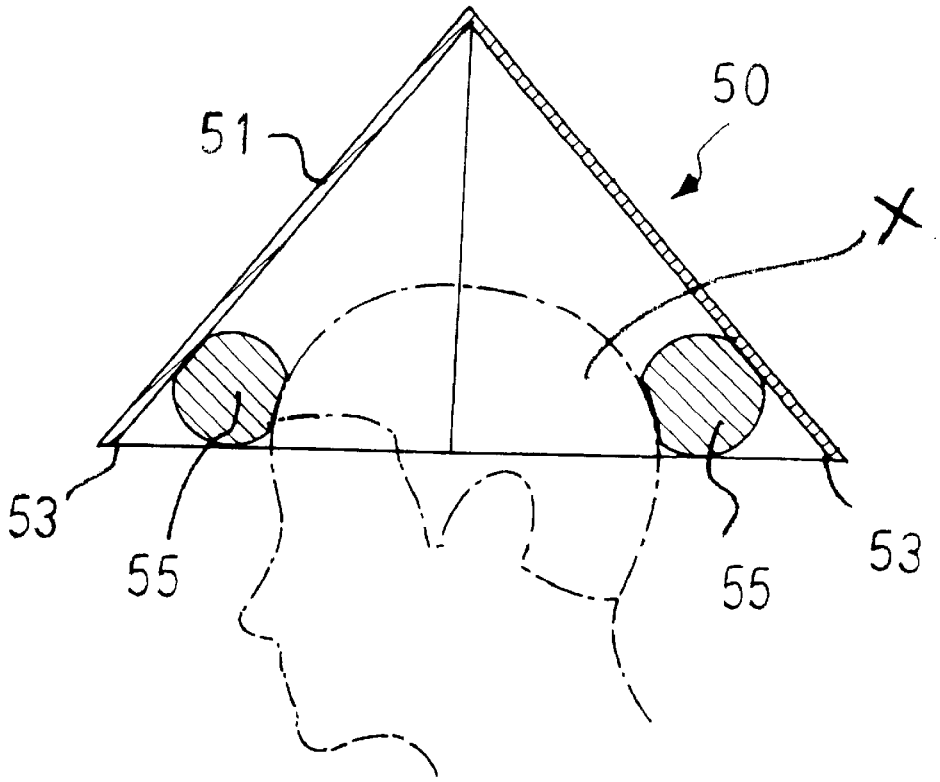
FIG. 13 is a sectional view showing a usage condition of the head wearing the fifth hat.

FIGS. 11, 12 and 13 are drawings of a fifth hat 50 relating to the present invention. FIG. 11 is a bottom view of the fifth hat; FIG. 12 is a bottom view for showing another preferred embodiment of the fifth hat; and FIG. 13 is a sectional view for showing a wearing condition of the fifth hat on the head.

The fifth hat 50 is composed of a hollow, generally square pyramidal main, body 51 manufactured of similar material in a similar method to the second hat 20. A plurality of locking pieces 55 composed of elastic bodies manufactured of materials, for example, polyurethane or polystyrene are attached at corner portions 53 of an opening portion 52 which is a wholly opened base in order to chock the head X.

Incidentally, a shape of the above-mentioned locking piece 55 is not limited to a sphere but also can be a circular cylinder, that is another locking piece 55 *a* as shown in the hat 50*a* of FIG. 12, in order to provide higher stability. Further, the position where the locking piece 55 is attached is not limited to each of the corner portions 53 in the pyramidal main body 51 but also can be attached in the middle of each of sides 53*a* comprising an opening portion 52*a* provided at the base of the pyramidal main body 51*a*.

As the fifth hat 50 provides the locking portions 55 at each of the corner portions 53 of the opening portion 52 or the locking portions 55*a* in the middle of each of the sides 53*a* of the opening 52*a*, manufacturing processes can be simplified, thereby saving manufacturing costs and being extremely economical.

In the event of wearing the fifth hat 50, the locking portions 55 provided at each of the corner portions 53 of the opening portion 52 of the base or the locking portions 55*a* provided in the middle of each of the sides 53*a* of the opening portion 52*a* make a point-contact with the circumference of the head and secure the hat, thereby providing an advantage of wearing the hat comfortably without feeling tighten or compressed by the hat.

Figure 14:
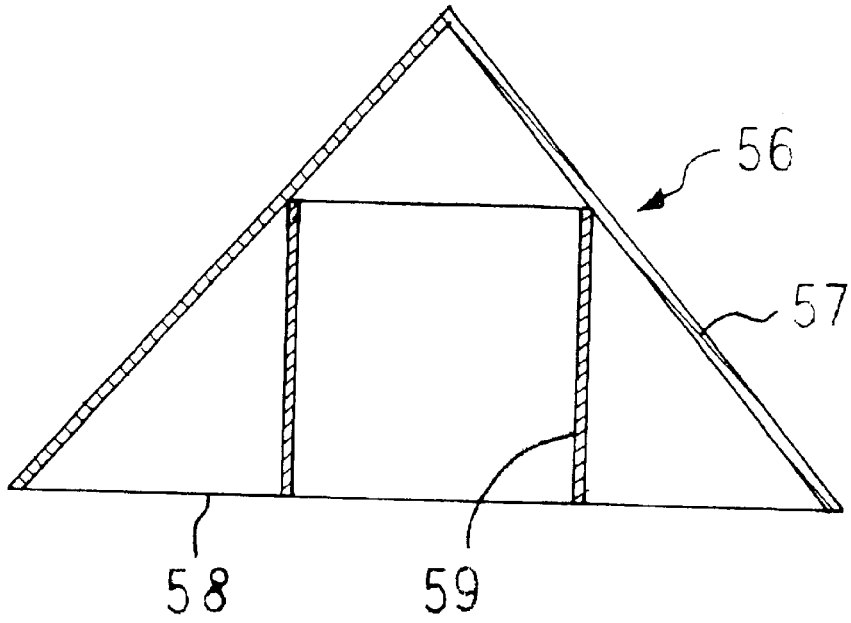
FIG. 14 is a sectional view of a sixth hat for showing a sixth preferred embodiment of the present invention.

FIG. 14 is a sectional view of a sixth hat 56 showing a sixth preferred embodiment relating to the present invention. The sixth hat 56 is composed of a hollow, generally square pyramidal main body 57 manufactured of similar material in a similar method to the second hat 20. A tubular body 59 for chocking the head X is provided in a center portion inside of an opening portion 58 which is a wholly opened base.

The sixth hat 56 is formed by providing the tubular body 59 at the center portion inside of the main body in a simple structure. Therefore, the manufacturing processes can be reduced and the costs are economized.

Figure 15:
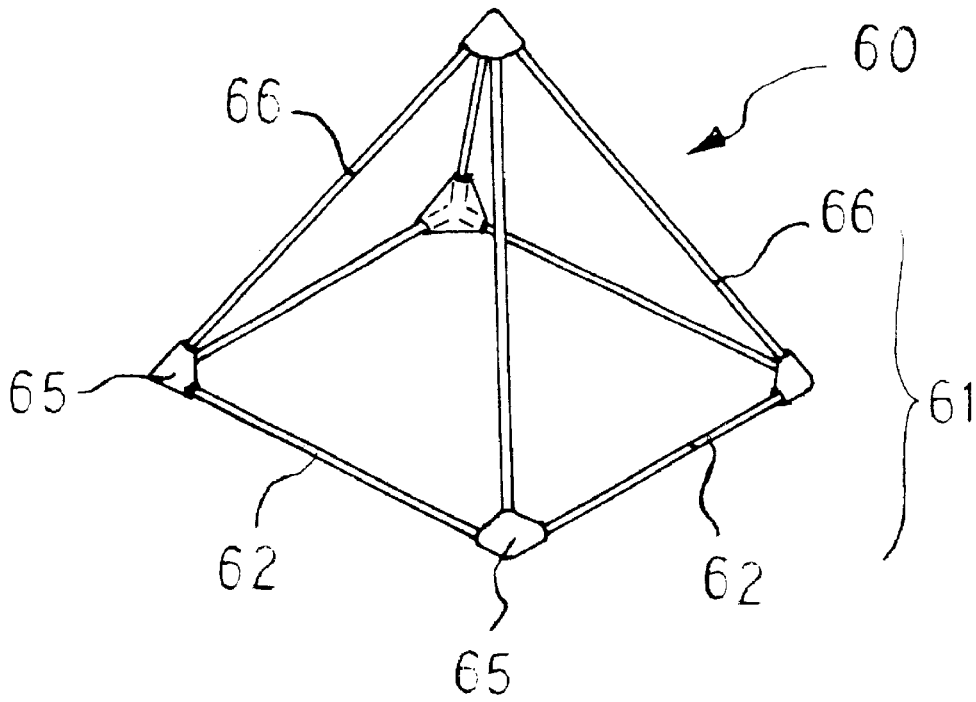
FIG. 15 is a perspective view of a skeleton framework of a seventh hat showing a seventh preferred embodiment of the present invention.
Figure 16:
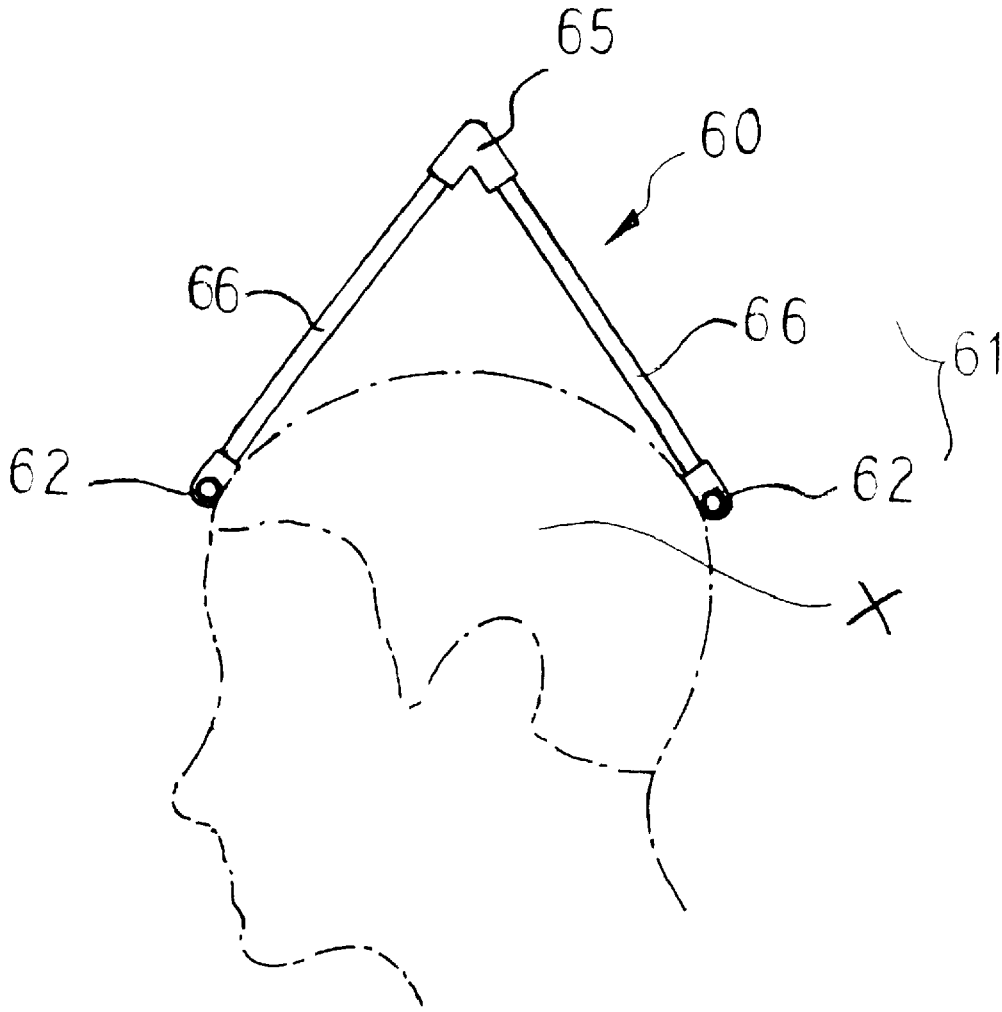
FIG. 16 is a sectional view showing a usage condition of the head wearing the seventh hat.

FIGS. 15 and 16 are diagrams of a seventh hat showing a seventh preferred embodiment relating to the present invention. FIG. 15 is a perspective view showing a skeleton framework and FIG. 16 is a sectional view showing a wearing condition of the seventh hat on the head.

The seventh hat 60 is formed in a pyramid as a whole, in which a generally square shape is formed by connecting a plurality of locking pipes 62 with connecting pieces 65 from which supporting pipes 66 are protruded upward and meet to each other at a top in order to form a skeleton framework 61 in a pyramidal shape. Incidentally, as material of the connecting piece 65, for example, a metal joint, synthetic resin, paper, clay and the like are available, and as material of the skeleton framework 61, for example, plastic, stainless, paper pipe are available. However, there is no limit to the materials.

The seventh hat 60, comprising locking pipes 62, supporting pipes 66 and connecting pieces 65, can be easily customized to suit the size of the wearer's head by cutting the locking pipes 62 to a proper length.

Therefore, the wearing conditions of the hat 60 can be arranged by adjusting the depth and the angle accurately to reach a predetermined position where the energy can be exerted at the highest level, thereby providing the psychological effects that the blood circulation of the brains can be facilitated strongly.

Figure 17:
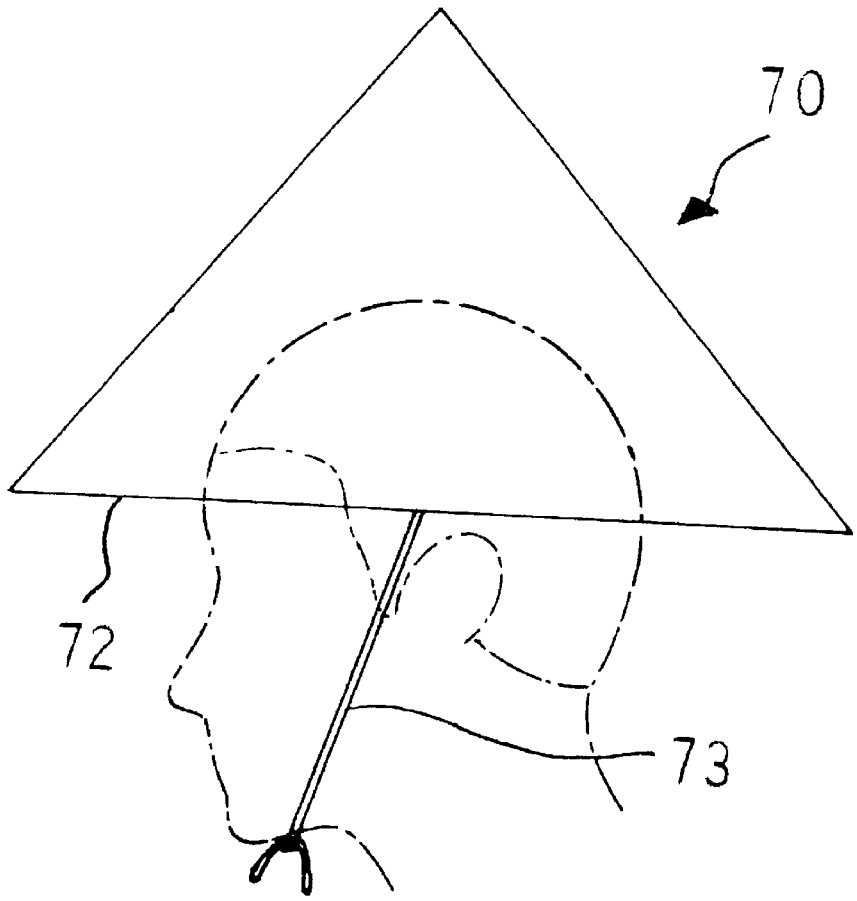
FIG. 17 is a side view showing a usage condition of an eighth hat of an eighth preferred embodiment of the present invention.

FIG. 17 is an explanatory diagram showing a wearing condition of an eighth hat of an eighth preferred embodiment relating to the present invention. The eighth hat 70 is formed in a generally square pyramid as the above-mentioned first hat through the seventh hat and provides strings 73 at generally central portions of both opposing sides of the base 72.

The eighth hat 70 can be worn stably in a proper depth and angle even when a wearer shakes his or her head, because the strings 73 are provided at generally central portions of both opposing sides of the base 72.

While the invention has been described in several preferred embodiments as above, it is to be understood that the present invention is not limited to the above-mentioned preferred embodiments and various modifications can be made within the purview of equality.

The hat 20 is composed solidly of a pyramidal main body manufactured of soft material; has a fitting portion in a generally central portion of a base to cover the head safely without adding a load; and is capable of exerting pyramid power effectively in order to provide psychological effects facilitating the blood circulation of the brain. That is, with the above-mentioned invention, a light hat putting little load upon the head while wearing can be provided, in which the pyramid power can be exerted effectively and the psychological effects for facilitating the blood circulation of the brain are provided.

The hat of FIG. 4 is composed of a hollow pyramid as a whole with a locking hole in a central portion of a base thereof. The above-mentioned hat is light, easily manufactured with low costs, and capable of providing the psychological effects that the pyramid power is exerted effectively.

The hat of FIGS. 4–7 is capable of reducing repulsive stress against folding force by forming a wide folding groove along a periphery of the base, composing a generally square pyramid accurately with an acute bottom portion, and providing the psychological effects that the pyramid power can be surely exerted.

The hats of FIGS. 8 and 10 provide a chocking portion formed integrally in the main body and composed of foldable chocking pieces formed by cutting a plurality of slits spaced evenly around the rim of the above-mentioned locking hole, which allows each of the chocking pieces, the chocking portion, and the locking pieces fits to the circumference of the head, thereby providing a comfortable and stable wearing condition and psychological effects that pyramid power is exerted.

The hat of FIG. 15 provides a custom-made hat comprising locking pipes and supporting pipes connected by connecting pieces in order to form a pyramid whose size is adjustable to a size of the wearer's head by cutting the locking pipes in a desired length. Therefore, the above-mentioned hat can be worn in desired positions or angles and provides the psychological effects that the pyramid power is exerted more effectively.

The hat of FIG. 17 provides strings at center portions of both opposing sides on the periphery of the base in order that the hat fits to the wearer's head comfortably regardless of the size without slipping off the head. These strings can be used with any of the hats of FIGS. 1–16.

What is claimed is:

1. A hat having a pyramidal main body formed into a generally square pyramid comprising sides and a base defining a chamber, said pyramidal main body being hollow and shaped in generally square pyramid, whereby said chamber is pyramid-shaped, a fitting portion formed in the base of the pyramidal main body; the fitting portion being sized and shaped such that a wearer's head will extend at least one-third of the way into the pyramid defined by said body when the hat is worn.

2. The hat as claimed in claim 1, wherein said pyramidal main body provides an integrally formed fitting portion composed of a semi-spherical concave portion disposed in a generally central portion of the base in a direction of a top portion.

3. The hat as claimed in claim 1, wherein a wide folding groove is provided along the periphery of the base of said pyramidal main body.

4. The hat as claimed in claim 1, wherein a generally circular locking hole is formed at a generally central portion in the base of said pyramidal main body.

5. The hat as claimed in claim 4, wherein the generally circular locking hole is formed at a generally central portion in the base and foldable chocking pieces are provided by cutting a plurality of evenly spaced slits on the rim of the locking hole of said pyramidal main body.

6. The hat as claimed in claim 4, wherein the generally circular locking hole in said pyramidal main body is comprised of chocking portions which are formed of a plurality of slits in the form of a vortex extending in an outward direction from the central portion to the periphery of the base and can be curved upward by spreading each of the slits.

7. The hat as claimed in claim 1, wherein the base of said pyramidal main body is wholly opened, said fitting portion comprising locking pieces internally attached to the pyramidal body of said hat.

8. The hat as claimed in claim 7, wherein said locking pieces comprises a spherical and/or a cylindrical members.

9. The hat as claimed in claim 1, wherein the base of said pyramidal main body is wholly opened and said fitting portion comprises a cylindrical body provided at a generally central portion of the opening portion.

10. The hat as claimed in claim 1, wherein strings are provided at generally central portions of both opposing sides of the base.

11. The hat as claimed in claim 1 wherein said pyramidal main body is made from synthetic resin, rubber, paper or cloth.

* * * * *